US005718254A

United States Patent [19]

Murphy

[11] Patent Number: 5,718,254

[45] Date of Patent: Feb. 17, 1998

[54] ADJUSTABLE BED CANOPY AND CURTAIN SYSTEM

[76] Inventor: David A. Murphy, 1208A-2055 Carling Avenue, Ottawa, Ontario, Canada, K2A1G6

[21] Appl. No.: 735,187

[22] Filed: Oct. 25, 1996

[51] Int. Cl.[6] ..... A47C 29/00

[52] U.S. Cl. ..... 135/96; 135/141; 135/142; 135/115; 5/113

[58] Field of Search ..... 135/96, 141, 142, 135/115; 5/414, 413 R, 113, 85.1, 512

[56] References Cited

U.S. PATENT DOCUMENTS

| | | | |
|---|---|---|---|
| 493,305 | 3/1893 | Sherman | 5/414 X |
| 785,571 | 3/1905 | Raines et al. | 135/142 |
| 1,395,158 | 10/1921 | Smith | 5/414 X |
| 1,563,736 | 12/1925 | Fink | 135/142 X |
| 1,737,664 | 12/1929 | Maness | 135/142 |
| 2,737,397 | 3/1956 | Turner | 135/96 X |
| 3,311,118 | 3/1967 | Gutner | 5/113 X |
| 4,295,482 | 10/1981 | McMullen | 5/414 X |
| 4,941,500 | 7/1990 | Emard | 135/141 |
| 5,255,698 | 10/1993 | Riley | 135/142 |
| 5,507,046 | 4/1996 | Taylor | 5/414 |

*Primary Examiner*—Christopher Kent

[57] ABSTRACT

An adjustable bed canopy and curtain system including a sheet of fabric, at least four vertical post and a frame member. The frame member has a first pair of "L" shaped tubular members and a second pair of "L" shaped tubular members. Each of the first and second pair of "L" shaped tubular members have a lower elongated portion and an upper elongated portion. Each of the first and second pair of "L" shaped tubular members have a horizontal bar projecting from one of the lower elongated portions and capable of coupling with a horizontal bar of another of the lower elongated portions. The upper elongated portion, of each of the first pair of tubular members, receives the upper elongated portions of the second pair of tubular members when the horizontal bars of each tubular member are coupled. Each of the lower elongated portions, of each of the first and second tubular members, are positioned over one of the four vertical post when the first and second pair of tubular members are coupled. The sheet of fabric is positioned over the coupled first and second tubular members.

9 Claims, 3 Drawing Sheets

10
14
16
122
18
20
22
26
118

14
50
122
24
20

ADJUSTABLE BED CANOPY AND CURTAIN SYSTEM

BACKGROUND OF THE INVENTION

1. Field of the Invention

The present invention relates to an adjustable bed canopy and curtain system and more particularly pertains to providing a system that has a plurality of tubular members coupled together and coupled to vertical posts for forming a frame that can be positioned around any bed of any size and further includes a sheet draped over the frame to transform the bed into a canopy bed.

2. Description of the Prior Art

The use of a canopy is known in the prior art. More specifically, canopies heretofore devised and utilized for the purpose of enclosing a bed are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,241,717 to Ward et al. discloses protective structure and bed frame with rigid canopy. U.S. Pat. No. 4,965,895 to Shustov discloses an earthquake shelter with bed support and canopy. U.S. Pat. No. 4,945,586 to Cross, Markowitz and Selgrath discloses a canopy bed frame assembly. U.S. Pat. Des. No. 299,193 to Brandis, Jr. discloses a canopy for a bed. U.S. Pat. Des. No. 283,179 to Scully and Waxman discloses a canopy bed. Lastly, U.S. Pat. No. 4,068,333 to Gutner discloses a canopy frame for bed.

While these devices fulfill their respective, particular objectives and requirements, the aforementioned patents do not describe an adjustable bed canopy and curtain system that provides a system that will turn any bed turned into a canopy bed by using a frame formed from interlocking tubular members and vertical post, with the frame covered by a sheet of fabric.

In this respect, the adjustable bed canopy and curtain system according to the present invention substantially departs from the conventional concepts and designs of the prior art, and in doing so provides an apparatus primarily developed for the purpose of a system that has a plurality of tubular members coupled together and coupled to vertical posts for forming a frame that can be positioned around any bed of any size and further includes a sheet draped over the frame to transform the bed into a canopy bed.

Therefore, it can be appreciated that there exists a continuing need for a new and improved adjustable bed canopy and curtain system which can be used to provide a system that has a plurality of tubular members coupled together and coupled to vertical posts for forming a frame that can be positioned around any bed of any size and further includes a sheet draped over the frame to transform the bed into a canopy bed. In this regard, the present invention substantially fulfills this need.

SUMMARY OF THE INVENTION

In view of the foregoing disadvantages inherent in the known types of canopies now present in the prior art, the present invention provides an improved adjustable bed canopy and curtain system. As such, the general purpose of the present invention, which will be described subsequently in greater detail, is to provide a new and improved adjustable bed canopy and curtain system and method which has all the advantages of the prior art and none of the disadvantages.

To attain this, the present invention essentially comprises a generally rectangular sheet of fabric. The sheet of fabric has a top portion with a pair of short side portions and a pair of long side portions extending from the sheet. One of each of the short side portions is contiguous with each of the pair of long side portions. Each short side portion has a slit therein and each long side portion has a slit therein, and forms corner panels. Included are at least four vertical posts. Each has an upper end and a lower end with a foot portion. Each of the vertical posts has a locking protrusion that projects from the post. The locking protrusion of each of the vertical posts has a leaf spring fixedly attached to an interior surface of the vertical posts. The leaf spring, of each of the vertical post, allows the locking protrusion to be pressed from the projected position into a position flush with an exterior surface of the respective vertical post.

Also, a frame member has a first pair of "L" shaped tubular members and a second pair of "L" shaped tubular members. Each of the first pair of "L" shaped tubular members have a lower elongated portion with a bottom edge. Each of the first pair of "L" shaped tubular members have an upper elongated portion with a top edge. The lower elongated portions and the upper elongated portions of the first pair of tubular member having a uniform diameter. Each of the second pair of "L" shaped tubular members has a lower elongated portion with a bottom edge, each of the second pair of "L" shaped tubular members having an upper elongated portion with a top edge. The lower elongated portions of the second pair of tubular members having a diameter. The upper elongated portions of the second pair of tubular members having a diameter less than the diameter of the lower elongated portions of the second tubular member.

One of the first pair of "L" shaped tubular members has a horizontal bar projecting outwardly. Another of the first pair of "L" shaped tubular members has a horizontal bar projecting outwardly, and sized for positioning within the horizontal bar of the one first pair of tubular members. One of the second pair of "L" shaped tubular members has a horizontal bar projecting outwardly. Another of the second pair of "L" shaped tubular members has a horizontal bar projecting outwardly, and sized for positioning within the horizontal bar of the one second pair of tubular members. The diameter of each of the upper elongated portions of each first pair of tubular members is sized for receiving one of the upper elongated portions of the second pair of tubular members to allowing coupling between the first tubular member and the second tubular member. Each of the lower elongated portions of each of the first tubular members and each of the lower elongated portions of each of the second tubular member are positioned over one of the four vertical posts. This placement occurs when the first and second tubular members are coupled.

Lastly, the top portion of the rectangular sheet of fabric is positioned over the coupled first and second pair of tubular members. The corner panels of the sheet of fabric are gathered when adjacent the lower elongated portions of the coupled first and second pair of tubular members and form a plurality of canopy corner panels. The plurality of canopy corner panels cover the lower elongated portions of the coupled first and second pair of tubular members when the lower elongated portions are positioned over the four vertical posts. The frame with the sheet of fabric is positioned over and around a bed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable bed canopy and curtain system which has all of the advantages of the prior art canopies and none of the disadvantages.

It is another object of the present invention to provide a new and improved adjustable bed canopy and curtain system which may be easily and efficiently manufactured and marketed.

It is further object of the present invention to provide a new and improved adjustable bed canopy and curtain system which is of durable and reliable constructions.

An even further object of the present invention is to provide a new and improved adjustable bed canopy and curtain system which is susceptible of a low cost of manufacture with regard to both materials and labor, and which accordingly is then susceptible of low prices of sale to the consuming public, thereby making such adjustable bed canopy and curtain system economically available to the buying public.

Even still another object of the present invention is to provide an adjustable bed canopy and curtain system for providing a system that has a plurality of tubular members coupled together and coupled to vertical posts for forming a frame that can be positioned around any bed of any size and further includes a sheet draped over the frame to transform the bed into a canopy bed.

Lastly, it is an object of the present invention to provide a new and improved adjustable bed canopy and curtain system. The system includes a sheet of fabric, at least four vertical posts and a frame member. The frame member has a first pair of "L" shaped tubular members and a second pair of "L" shaped tubular members. Each of the first and second pair of "L" shaped tubular members have a lower elongated portion and an upper elongated portion. Each of the first and second pair of "L" shaped tubular members have a horizontal bar projecting from one of the lower elongated portions and capable of coupling with a horizontal bar of another of the lower elongated portions. The upper elongated portion, of each of the first pair of tubular members, receives the upper elongated portion of each of the second pair of tubular members when the horizontal bars of each tubular member are coupled. Each of the lower elongated portions, of each of the first and second tubular members, are positioned over one of the four vertical post when the first and second pair of tubular members are coupled. The sheet of fabric is positioned over the coupled first and second tubular members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
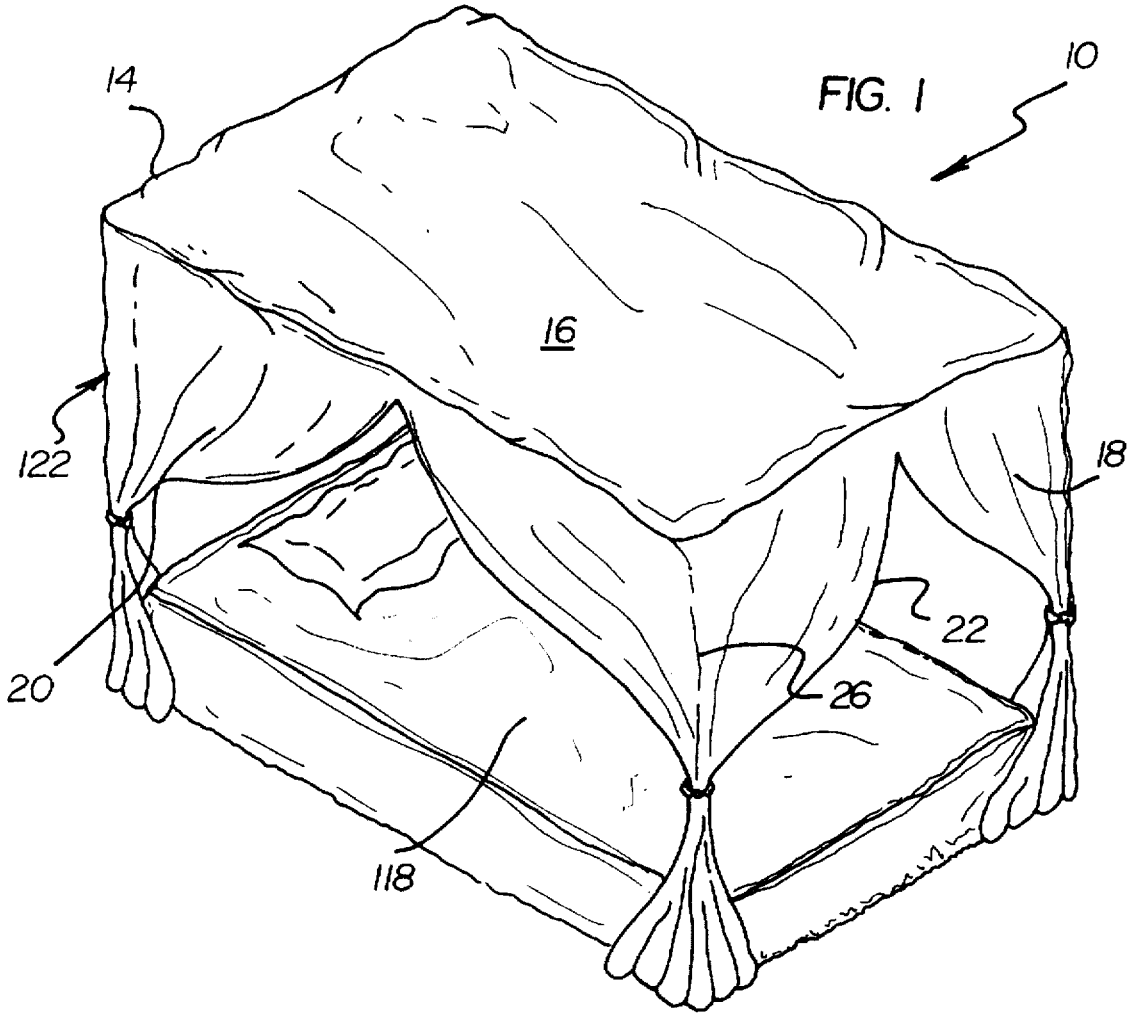
FIG. 1 is a perspective view of the preferred embodiment of the adjustable bed canopy and curtain system constructed in accordance with the principles of the present invention.
Figure 2:
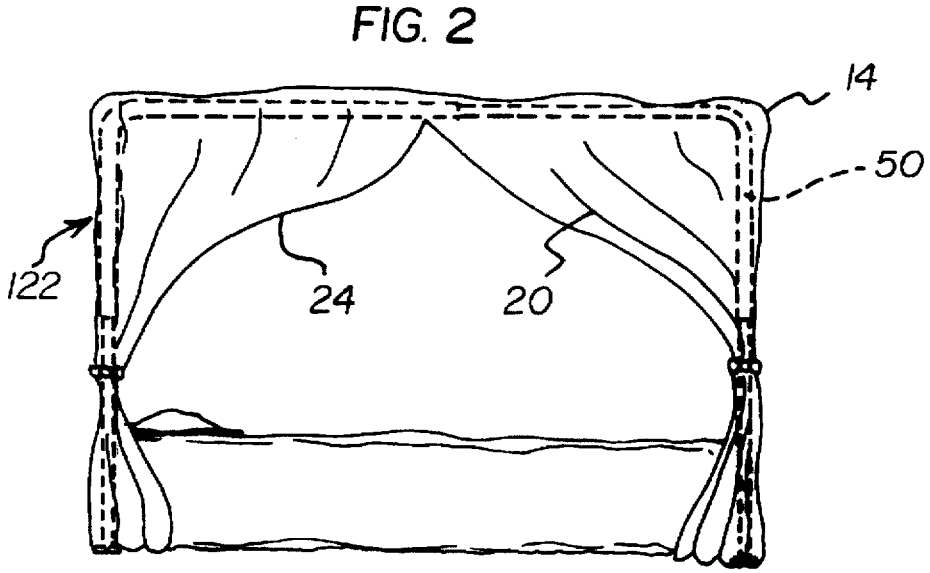
FIG. 2 is a side view of the present invention of FIG. 1.

With reference now to the drawings, and in particular to FIG. 1 thereof, the preferred embodiment of the new and improved Adjustable bed canopy and curtain system embodying the principles and concepts of the present invention and generally designated by the reference numeral 10 will be described.

The present invention, the Adjustable bed canopy and curtain system 10 is comprised of a plurality of components. Such components in their broadest context include a frame and a sheet of fabric. Such components are individually configured and correlated with respect to each other so as to attain the desired objective.

Specifically, the present invention includes a generally rectangular sheet of fabric 14. The sheet has a top portion 16 with a pair of short side portions 18 and a pair of long side portions 20. The short side portions and the long side portions, as seen in FIG. 1, extend from the top portion. One of each short side portion is contiguous with each of the pair of long side portions. Each short side portion has a slit 22. Each long side portion has a slit 24. Slits in the pair of short side portions and the pair of long side portions allow for the formation of corner panels 26.

Figure 3:
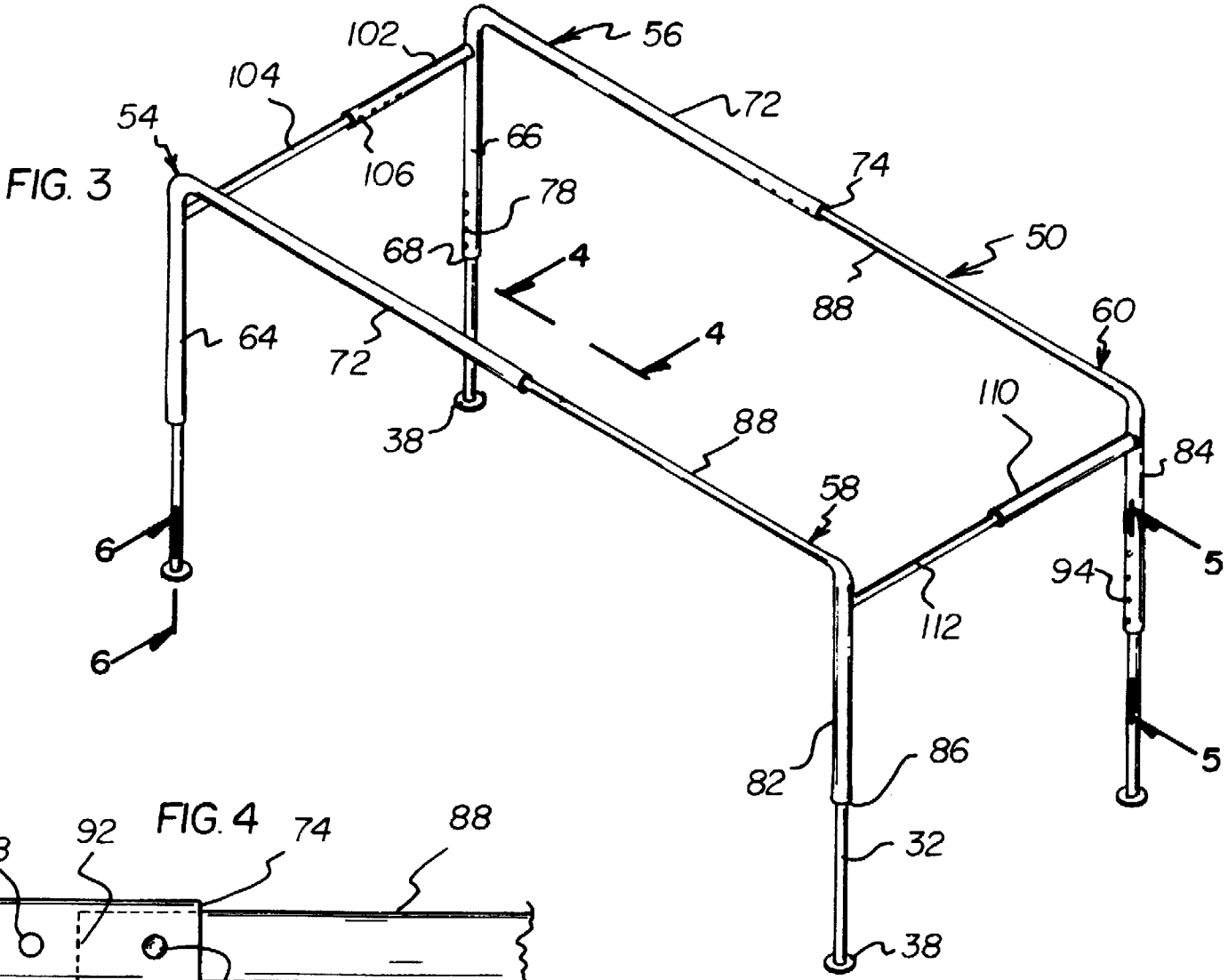
FIG. 3 is an isometric view of the frame of the present invention.
Figure 5:
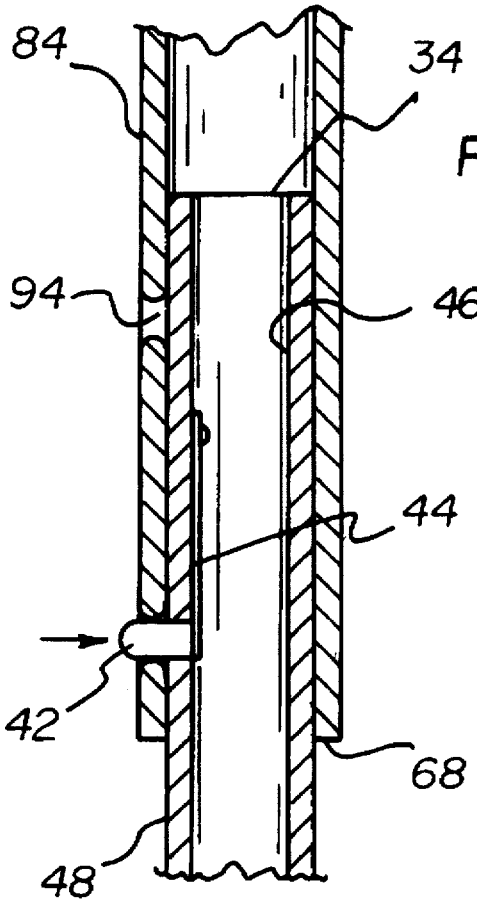
FIG. 5 is a cut-away cross-sectional view of the present invention taken along line 5—5 of FIG. 3.
Figure 6:
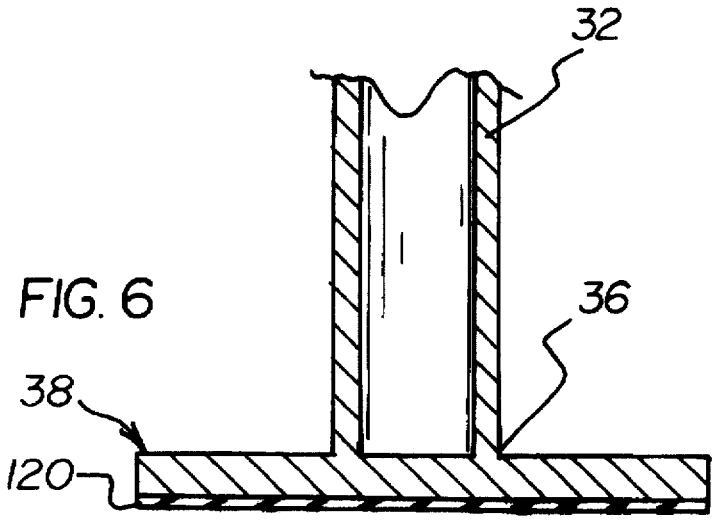
FIG. 6 is a cross-sectional view of the foot of the vertical post of the present invention taken along line 6—6 of FIG. 3.

As best illustrated in FIG. 3, at least four vertical posts 32 are included. Each vertical post has an upper end 34 and a lower end 36 with a foot portion 38. Each vertical post, as seen in FIG. 5, has a locking protrusion 42. The locking protrusion of each vertical post projects outwardly from the vertical post. The locking protrusion of each of the vertical posts has a leaf spring 44 that is fixedly attached to an interior surface 46 of the vertical post. The leaf spring of each of the vertical posts will allow the locking protrusion to be pressed and removed from the projected position to a position flush with an exterior surface 48 of the respective vertical post.

Also, a frame member 50 is provided. The frame member has a first pair of "L" shaped tubular members 54 and 56, and a second pair of "L" shaped tubular members 58 and 60. Each of the first pair of "L" shaped tubular members have a lower elongated portion 64 and 66 with a bottom edge 68. Each of the first pair of "L" shaped tubular members have an upper elongated portion 72 with a top edge 74. The lower elongated portion and the upper elongated portion of the first pair of tubular members have a uniform diameter. The lower elongated portion and the upper elongated portion of the first pair of tubular members each have a plurality of apertures 78. The apertures of the lower elongated portions of the first pair of tubular members are proportionately spaced from the bottom edge 68. The apertures of the upper elongated portions of the first pair of tubular members are proportionately spaced from the top edge 74.

Additionally, each of the second pair of "L" shaped tubular members have a lower elongated portion 82 and 84 with a bottom edge 86. Each of the second pair of "L" shaped tubular members have an upper elongated portion 88 with a top edge 92. The lower elongated portions of the second pair of tubular members have a diameter. The upper elongated portions of the first pair of tubular members have a diameter less than the diameter of the lower elongated portions of the second pair of tubular members.

Figure 4:
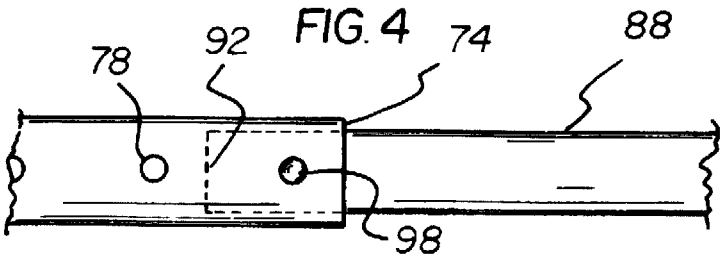
FIG. 4 is a cut-away view of the present invention taken along line 4—4 of FIG. 3.

The lower elongated portions and the upper elongated portions of the second pair of tubular members each have a plurality of apertures 94. The apertures of the lower elongated portions of the second pair of tubular members are proportionately spaced from the bottom edge 86. The apertures of the upper elongated portions of the second pair of tubular members are proportionately spaced from the top edge 92. Each of the upper elongated portions of the second pair of tubular members have a locking protrusion 98, as seen in FIG. 4. The locking protrusion 98 of the upper elongated portions of the second pair of tubular members function identical to the locking protrusion 42 of FIG. 5 and described above.

It can be seen in FIG. 3 that one of the first pair of "L" shaped tubular members 56 has a horizontal bar 102 projecting outwardly. Another of the first pair of "L" shaped tubular members 54 has a horizontal bar 104 projecting outwardly. The horizontal bar of the other of the pair of "L" shaped tubular members is sized to be positioned within the horizontal bar 102 of the one first pair of tubular members 56. The two horizontal bars are locked in position with a locking protrusion 106 like the one depicted in FIG. 5. One of the second pair of "L" shaped tubular members 60 has a horizontal 110 bar projecting outwardly. Another of the second pair of "L" shaped tubular members 58 has a horizontal bar 112 projecting outwardly. The horizontal bar 112 is sized to be positioned and locked within the horizontal bar 110 of the one second pair of tubular members 60.

Furthermore, The diameter of each of the upper elongated portions 88 of each first pair tubular members is sized to receive one of the upper elongated portions of the second tubular members and couples of the first tubular member and the second tubular member. Each of the lower elongated portions of each of the first pair of tubular members and each of the lower elongated portions of each of the second pair of tubular members are positioned over one of the four vertical posts when the first and second tubular members are coupled. When the lower elongated portions of the frame are coupled to the vertical posts the foot portions allows the frame to be positioned upright around a bed 118. The foot portions each have a non-slip pad 120 to increase the stability of the frame by preventing excess movement of the frame.

Lastly, the top portion 16 of the rectangular sheet of fabric is positioned over the coupled first and second pair of tubular members of the frame 50. The corner panels 26 of the sheet of fabric are gathered, when adjacent the lower elongated portions of the coupled first and second pair of tubular members, to form a plurality of canopy corner panels 122. The plurality of canopy corner panels cover the lower elongated portions of the coupled first and second pair of tubular members. This positioning of the sheet 14 is done when the lower elongated portions are positioned over the four vertical posts. Finally, the frame with the sheet of fabric over it is placed around the bed.

The present invention is an adjustable bed canopy and curtain system that provides a simple and easy way to turn any standard bed into a canopy bed. The frame of the invention is structured from metal or plastic tubing. The vertical posts that support the frame are constructed of the same material used to make the frame. The frame uses interlocking tubing that allows the height, length and width of the frame to be adjusted to match the bed size. The tubing may be made available so as to fit beds ranging to a toddler's bed to a king size bed. The foot portion of each of the vertical post is covered with a non-slip material, preferably rubber. The non-slip material helps to stabilize the frame when it is positioned around the bed and will prevent damage to flooring or carpeting. The sheet of fabric used with the frame is any material of choice. Once the fabric is draped over the frame member the corner panels are gathered and held in place by a tie.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable bed canopy and curtain system comprising, in combination:

a generally rectangular sheet of fabric having a top portion with a pair of short side portions and a pair of long side portions extending therefrom, one of each short side portion being contiguous with each of the pair of long side portions, each short side portion having a slit therein and each long side portion having a slit therein for forming corner panels;

at least four vertical posts each having an upper end and a lower end with a foot portion, each of the vertical post of the four vertical posts having a locking protrusion projecting therefrom, the locking protrusion of each of the vertical post having a leaf spring fixedly attached to an interior surface of the vertical post, the leaf spring of each of the vertical posts allowing the locking protrusion to be pressed from a projected position into a position flush with an exterior surface of a respective vertical post;

a frame member having a first pair of "L" shaped tubular members and a second pair of "L" shaped tubular members, each of the first pair of "L" shaped tubular members having a lower elongated portion with a bottom edge, each of the first pair of "L" shaped tubular members having an upper elongated portion with a top edge, the lower elongated portions and the upper elongated portions of the first pair of tubular members having a uniform diameter, each of the second pair of "L" shaped tubular members having a lower elongated portion with a bottom edge, each of the second pair of "L" shaped tubular members having an upper elongated portion with a top edge, the lower elongated portion of each of the second pair of tubular members having a diameter, the upper elongated portion of each of the first pair of tubular members having a diameter less than the diameter of the lower elongated portion of each of the second pair of "L" shaped tubular members;

one of the first pair of "L" shaped tubular members having a horizontal bar projecting outwardly therefrom, another of the first pair of "L" shaped tubular members having a horizontal bar projecting outwardly therefrom and sized to be positioned within the horizontal bar of the one first pair of tubular members, one of the second pair of "L" shaped tubular members having a horizontal bar projecting outwardly therefrom, another of the second pair of "L" shaped tubular members having a horizontal bar projecting outwardly therefrom and sized to be positioned within the horizontal bar of the one second pair of tubular members, the diameter of each of the upper elongated portions of each first pair of tubular members being sized to receive one of the upper elongated portions of the second tubular members and couples the first pair of tubular members and the second pair of tubular members, each of the lower elongated portions of each of the first pair of tubular members and each of the lower elongated portions of each of the second pair tubular member being positioned over one of the four vertical posts when the first and second pair of tubular members are coupled; and the top portion of the rectangular sheet of fabric being positioned over the first and second pair of tubular members when coupled one to the other, the corner panels of the sheet of fabric being gathered when adjacent the lower elongated portions of the coupled first and second pair of tubular members and forming a plurality of canopy corner panels, the plurality of canopy corner panels covering the lower elongated portions of the coupled first and second tubular members when the lower elongated portions are positioned over the four vertical post for positioning the frame with the sheet of fabric over and around a bed.

2. An adjustable bed canopy and curtain system comprising:

a sheet of fabric;

at least four vertical posts; and a frame member having a first pair of "L" shaped tubular members and a second pair of "L" shaped tubular members, each of the first and second pair of "L" shaped tubular members having a lower elongated portion and an upper elongated portion, each of the first and second pair of "L" shaped tubular members having a horizontal bar projecting from one of the lower elongated portions for coupling with a horizontal bar of another of the lower elongated portions, the upper elongated portion of each of the first pair of tubular members receiving the upper elongated portions of the second pair of tubular members when the horizontal bars of each tubular member are coupled, each of the lower elongated portions of each of the first and second pair of tubular members being positionable over one of the four vertical posts when the first and second pair of tubular members are coupled, the sheet of fabric being positioned over the coupled first and second tubular members.

3. The adjustable bed canopy and curtain system as set forth in claim 2, wherein the sheet of fabric having a top portion with a pair of short side portions and a pair of long side portions extending therefrom.

4. The adjustable bed canopy and curtain system as set forth in claim 3, wherein one of each short side portion of the sheet being contiguous with each of the pair of long side portions, each short side portion having a slit therein and each long side portion having a slit therein for forming corner panels.

5. The adjustable bed canopy and curtain system as set forth in claim 4, wherein the top portion of the sheet of fabric being positioned over the coupled first and second pair of tubular members, the corner panels of the sheet of fabric being gathered when adjacent the lower elongated portions of the coupled first and second pair of tubular members and forming a plurality of canopy corner panels, the plurality of canopy corner panels covering the lower elongated portions of the coupled first and second tubular members when the lower elongated portions are positioned over the four vertical posts for positioning the frame with the sheet of fabric over and around a bed.

6. The adjustable bed canopy and curtain system as set forth in claim 2, wherein each of the vertical posts having an upper end and a lower end with a foot portion and each of the vertical posts having a locking protrusion projecting therefrom.

7. The adjustable bed canopy and curtain system as set forth in claim 6, wherein the locking protrusion of each of the vertical posts having a leaf spring fixedly attached to an interior surface of the vertical post, and the leaf spring of each of the vertical posts allowing the locking protrusion to be pressed from a projected position into a position flush with an exterior surface of a respective vertical post.

8. The adjustable bed canopy and curtain system as set forth in claim 2, wherein the lower elongated portion and the upper elongated portion of the first pair of tubular members having a uniform diameter, the lower elongated portion of the second pair of tubular members having a diameter, and the upper elongated portion of the first pair of tubular members having a diameter less than the diameter of the lower elongated portion of the second pair of tubular members.

9. The adjustable bed canopy and curtain system as set forth in claim 6, wherein the lower elongated portions of each of the first and second tubular members having a plurality of holes capable of engaging the locking protrusion of any one of the vertical posts for securing one of the vertical posts within the respective lower elongated portion.

* * * * *